US010519712B2

(12) United States Patent
Alirezaei

(10) Patent No.: US 10,519,712 B2
(45) **Date of Patent: *Dec. 31, 2019**

(54) MOVABLE BARRIER SCREEN ASSEMBLY

(71) Applicant: Maryam Alirezaei, Mission Viejo, CA (US)

(72) Inventor: Maryam Alirezaei, Mission Viejo, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/804,897

(22) Filed: Nov. 6, 2017

(65) Prior Publication Data

US 2018/0283097 A1 Oct. 4, 2018

Related U.S. Application Data

(63) Continuation of application No. 15/476,529, filed on Mar. 31, 2017, now Pat. No. 9,850,703.

(51) Int. Cl.

| | |
|---|---|
| ***E06B 9/52*** | (2006.01) |
| ***E05F 15/686*** | (2015.01) |
| ***E05D 15/18*** | (2006.01) |
| *E05F 17/00* | (2006.01) |

(52) U.S. Cl.

CPC ..... *E06B 9/52* (2013.01); *E05D 15/18* (2013.01); *E05F 15/686* (2015.01); *E05F 17/002* (2013.01); *E05Y 2201/10* (2013.01); *E05Y 2400/415* (2013.01); *E05Y 2800/205* (2013.01); *E05Y 2900/106* (2013.01); *E05Y 2900/136* (2013.01)

(58) Field of Classification Search

CPC ..... E06B 9/52; E05F 15/686; E05F 17/002; E05D 15/18; E05Y 2900/136; E05Y 2900/106

USPC ..... 160/89, 90, 107, 113, 127, 218, 229.1

See application file for complete search history.

(56) References Cited

U.S. PATENT DOCUMENTS

| | | | | |
|---|---|---|---|---|
| 2,072,092 A | | 3/1937 | Blodgett | |
| 2,589,480 A | * | 3/1952 | Curtis | E05F 15/684 160/188 |
| 2,756,990 A | * | 7/1956 | Reamey | E05F 15/686 160/193 |
| 2,882,045 A | * | 4/1959 | Moore | E05F 15/673 318/266 |
| 3,021,896 A | | 2/1962 | Buono et al. | |
| 3,103,967 A | | 9/1963 | Gaschen | |
| 3,439,727 A | * | 4/1969 | Perl | E05F 15/686 160/188 |
| 4,231,191 A | * | 11/1980 | Ellmore | E05F 15/41 49/139 |

(Continued)

*Primary Examiner* — Johnnie A. Shablack

(74) *Attorney, Agent, or Firm* — Jafari Law Group, Inc.

(57) ABSTRACT

The present invention is generally a movable barrier assembly that includes a screen garage door that may be remotely operated to open and close an entry to a garage, thereby facilitating ventilation, and preventing debris such as leaves, insects, etc. from entering the garage. In an exemplary embodiment, a screen assembly includes a first track running substantially parallel to a second track on which a garage door travels. A movable barrier operator that actuates the garage door and screen door may include a first motor to operate the screen door, and a second motor to operate the garage door. In exemplary embodiments, a single control unit is configured to operate both motors and thus operate each movable barrier.

7 Claims, 6 Drawing Sheets

(56) References Cited

U.S. PATENT DOCUMENTS 4,281,475 A * 8/1981 Spadoni-Censi ..... E05F 15/668 318/266
4,328,540 A * 5/1982 Matsuoka ..... E05F 15/668 318/266
4,379,478 A 4/1983 Lichy
4,383,206 A * 5/1983 Matsuoka ..... H02H 7/0851 318/445
4,496,942 A * 1/1985 Matsuoka ..... G07C 9/00182 318/267
4,638,433 A * 1/1987 Schindler ..... E05F 15/668 160/189
4,653,565 A * 3/1987 Iha ..... E05F 15/686 160/193
5,050,660 A 9/1991 Bleichwehl
5,323,835 A 6/1994 Bachmeier
5,408,789 A 4/1995 Plfeger
5,427,169 A 6/1995 Saulters
5,758,704 A 6/1998 Elrod
5,848,630 A 12/1998 Manzo
5,899,254 A 5/1999 Cook
6,289,963 B1 9/2001 Vaske
6,326,754 B1 * 12/2001 Mullet ..... G07C 9/00182 318/266
6,394,171 B1 5/2002 Robbins, III
6,715,236 B2 4/2004 Mullet
6,719,032 B1 * 4/2004 Miers ..... E05F 15/67 160/188
6,741,052 B2 * 5/2004 Fitzgibbon ..... E05F 15/41 318/266
7,002,312 B2 * 2/2006 Wojciak, Jr. ..... G07C 9/00182 318/445
7,086,442 B1 8/2006 Esparza
7,151,351 B2 * 12/2006 Piechowiak ..... E05F 15/41 318/466
7,180,260 B2 * 2/2007 Murphy ..... G05B 19/4061 318/466
7,308,926 B1 12/2007 Hawkins
7,332,999 B2 * 2/2008 Fitzgibbon ..... G07C 9/00182 340/12.15
7,750,890 B2 * 7/2010 Fitzgibbon ..... E05F 15/668 340/5.71
8,151,858 B2 * 4/2012 Hughes ..... E05D 13/1215 160/113
8,279,040 B2 * 10/2012 Laird ..... E05F 17/00 318/103
8,307,876 B2 * 11/2012 Hughes ..... E05D 13/1215 160/116
8,345,010 B2 * 1/2013 Fitzgibbon ..... E05F 15/668 340/5.71
9,163,451 B1 * 10/2015 Curry ..... E06B 9/24
9,850,703 B1 * 12/2017 Alirezaei ..... E05F 15/686
2001/0042348 A1 11/2001 Lundahl
2002/0134518 A1 11/2002 Anderson
2002/0183008 A1 * 12/2002 Menard ..... G07C 9/00182 455/66.1
2004/0144499 A1 7/2004 Pannell
2005/0230067 A1 10/2005 Jordan
2005/0241783 A1 11/2005 Geres
2006/0137832 A1 6/2006 Alexander
2008/0017332 A1 1/2008 Daly
2008/0202698 A1 8/2008 Dalton et al.
2008/0295979 A1 * 12/2008 Carlsen ..... E05D 13/1261 160/197
2014/0069593 A1 3/2014 Gravel
2014/0230335 A1 8/2014 Muto
2014/0231030 A1 * 8/2014 James ..... E05F 15/668 160/188
2015/0225998 A1 8/2015 Muto
2016/0177608 A1 6/2016 Bruns et al.
2018/0283097 A1 * 10/2018 Alirezaei ..... E05F 15/686

* cited by examiner

MOVABLE BARRIER SCREEN ASSEMBLY

PRIORITY AND CROSS-REFERENCE TO RELATED APPLICATIONS

The present application is a continuation of pending U.S. patent application Ser. No. 15/476,529, filed on Mar. 31, 2017, its disclosure incorporated herein by reference in its entirety.

TECHNICAL FIELD OF THE INVENTION

The present invention relates in general to a movable barrier screen assembly, and more specifically, to a movable barrier assembly that includes a screen for a doorway of a garage that may be remotely operated, thereby facilitating ventilation and preventing debris from entering the garage.

COPYRIGHT & TRADEMARK NOTICE

A portion of the disclosure of this patent application may contain material that is subject to copyright protection. The owner has no objection to the facsimile reproduction by anyone of the patent documents or the patent disclosures, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and shall not be construed as descriptive or to limit the scope of this invention to material associated only with such marks.

BACKGROUND OF THE INVENTION

It is now common for movable barriers to include a movable barrier assembly that is remotely operated so that a movable barrier, such as a garage door, may be opened and closed via use of a remote control. This configuration is common in households throughout the United States, and many single-family homes include a garage space with a movable barrier assembly.

Often, garage spaces are not only used to store vehicles, but also as extra storage spaces, hobby or work spaces, and even used as personal gym space to store and utilize gym equipment. Due to the variety of uses that garage spaces are commonly utilized for, it is often desirable to have the garage door open while the space is in use. For example, an individual performing automotive work on their vehicle may desire to leave the door open so that the vehicle may be turned on and off during reparations or modification to the vehicle—so as to prevent harmful fumes from accumulating inside the garage. Similarly, a hobbyist painting or working on a project, or an individual working on their exercise routine, may desire to leave the garage door open to provide ventilation during their activity inside the garage. Sometimes, an individual organizing or storing items in their garage may find it desirable to facilitate ventilation by leaving the garage door open.

One problem is that leaving the garage door open often allows debris to enter the garage space. This is particularly true on cool spring or summer days that may be windy. Unfortunately, cool windy days are often those days during which working out of or inside a garage is particularly desirable.

A similar problem arises with regards to neighborhood animals such as pets or small animals that may wander into a family home via an opened garage. Naturally, a person using their garage may simply close the garage door when they leave momentarily, but this often proves to be a hassle and residents using the garage often opt to leave the garage door open momentarily rather than close it while they go inside.

Another similar problem arises out of concern for safety. Often, even if an individual feels comfortable working out of their garage with the garage door open, leaving the garage opened and unattended is typically an undesirable concern, as opened garage doors are known to invite vandals.

To address some of these problems, several attempts have been made to provide structures, devices, or components that may be affixed to or implemented with a movable barrier, such as a garage door or garage entry, in order to provide a screened entry. However, the problem with such devices is that they tend to be cumbersome to use, must be manually operated, and or are not easily controlled in the same manner that a typical garage door may be operated—such as via remote control.

Due to these limitations with prior art movable barriers, the need for providing a screen door to a garage entry has not been adequately addressed.

Therefore, there is a need in the art for a movable barrier assembly that includes a screen garage door that may be remotely operated to open and close an entry to a garage, thereby facilitating ventilation, preventing debris such as leaves, insects, etc. from entering the garage, and offering some measure of security by discouraging unwanted visitors. It is to these ends that the present invention has been developed.

BRIEF SUMMARY OF THE INVENTION

To minimize the limitations in the prior art, and to minimize other limitations that will be apparent upon reading and understanding the present specification, the present invention describes a movable barrier screen assembly, which includes a screen for a garage doorway that may be remotely operated.

A movable barrier screen assembly, in accordance with an exemplary embodiment of the present invention, comprises: a first movable barrier configured to travel along a first track and enclose an entry; a second movable barrier configured to travel along a second track, wherein the second movable barrier comprises a screen adapted to enclose the entry; a first motor configured to move the first barrier along the first track; and a second motor configured to move the second barrier along the second track, wherein the first track runs substantially parallel and above the second track.

A movable barrier screen assembly, in accordance with another exemplary embodiment of the present invention, comprises: a first movable barrier configured to travel along a first track and adapted to enclose an entry; a second movable barrier configured to travel along a second track, wherein the second movable barrier comprises a screen adapted to enclose the entry; and a movable barrier operator, including: a first motor configured to move the first barrier along the first track; a second motor configured to move the second barrier along the second track, wherein the first track runs substantially parallel and above the second track; and a control circuitry configured to provide power to drive the first and second motors.

A movable barrier screen assembly, in accordance with another exemplary embodiment of the present invention, comprises: a first movable barrier configured to travel along a first track and enclose an entry; a second movable barrier configured to travel along a second track, wherein the second movable barrier comprises a screen adapted to enclose the entry; a first movable barrier operator, comprising: a first motor configured to move the first barrier along the first track; and a first control circuitry configured to provide power to drive the first motor; and a second movable barrier operator, comprising: a second motor configured to move the second barrier along the second track, wherein the first track runs substantially parallel and above the second track; and a second control circuitry configured to provide power to drive the second motor.

It is an objective of the present invention to provide a means to remotely open and close a screen to a garage entry.

It is another objective of the present invention to facilitate airflow into a garage space, while preventing debris from entering the garage.

It is yet another objective of the present invention to facilitate airflow into a garage space, while preventing insects from entering the garage space.

It is yet another objective of the present invention to facilitate airflow into a garage space, while preventing animals such as neighbor's pets from entering the garage space.

It is yet another objective of the present invention to facilitate airflow into a garage space, while allowing some measure of privacy.

It is yet another objective of the present invention to provide some measure of security while allowing a garage door to remain open.

These and other advantages and features of the present invention are described herein with specificity so as to make the present invention understandable to one of ordinary skill in the art.

BRIEF DESCRIPTION OF DRAWINGS

Elements and embodiments in the figures have not necessarily been drawn to scale in order to enhance their clarity and improve understanding of the invention. Furthermore, elements that are known to be common and well understood to those in the industry are not depicted in order to provide a clear view of the various embodiments of the invention.

DETAILED DESCRIPTION OF THE INVENTION

Figure 1:
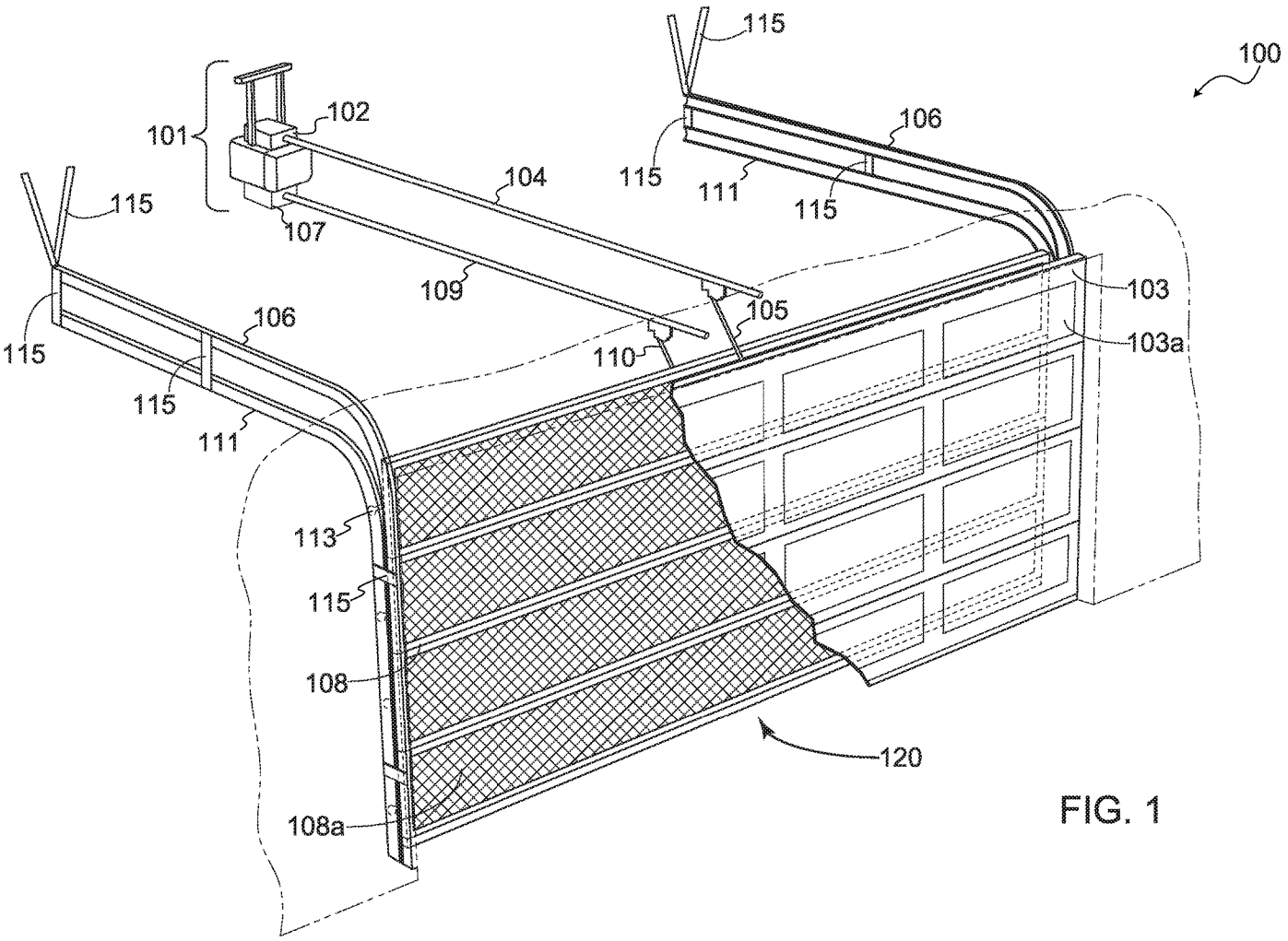
FIG. 1 illustrates a movable barrier screen assembly in accordance with an exemplary embodiment of the present invention, wherein both a garage door and a screen door are in a closed travel limit position.

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized and changes may be made without departing from the scope of the invention. Wherever possible, the same reference numbers are used in the drawings and the following description to refer to the same or similar elements. While embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims.

In the present specification, a movable barrier operator may be any system that controls a barrier to an entry, an exit, or a view. The barrier could be a door for a small entity (i.e. a person), or a gate for a large entity (i.e. a vehicle), which may swing out, slide open, or roll upwards. The operator, which moves the barrier from an open position to a closed position and vice-versa is typically although not necessarily automatic, and may be controlled locally or remotely. In exemplary embodiments, a movable barrier operator may refer to a garage door operator, which may include a single motor or multiple motors in a single housing configured to move one or more movable barriers. In the present specification, a movable barrier may refer specifically to a garage door, as well as a garage screen door adapted to close an entry to a garage, and a screen barrier may refer to a garage door screen or garage screen door.

Generally, the present invention involves a movable barrier assembly that includes a first movable barrier such as a garage door and a second movable barrier such as a screen door, both of which may be adapted to remotely open and close an entry to a garage. Because each barrier functions independently of the other, the assembly facilitates aeration of a garage space, while preventing debris such as leaves, insects, etc. from entering the garage. In an exemplary embodiment, a screen assembly includes a first track running substantially parallel to a second track on which a garage door travels. A movable barrier operator that actuates the garage door and screen door may include a first motor to operate the screen door, and a second motor to operate the garage door. In exemplary embodiments, a single control unit may be configured to operate both motors and thus operate each movable barrier independently.

Figure 3:
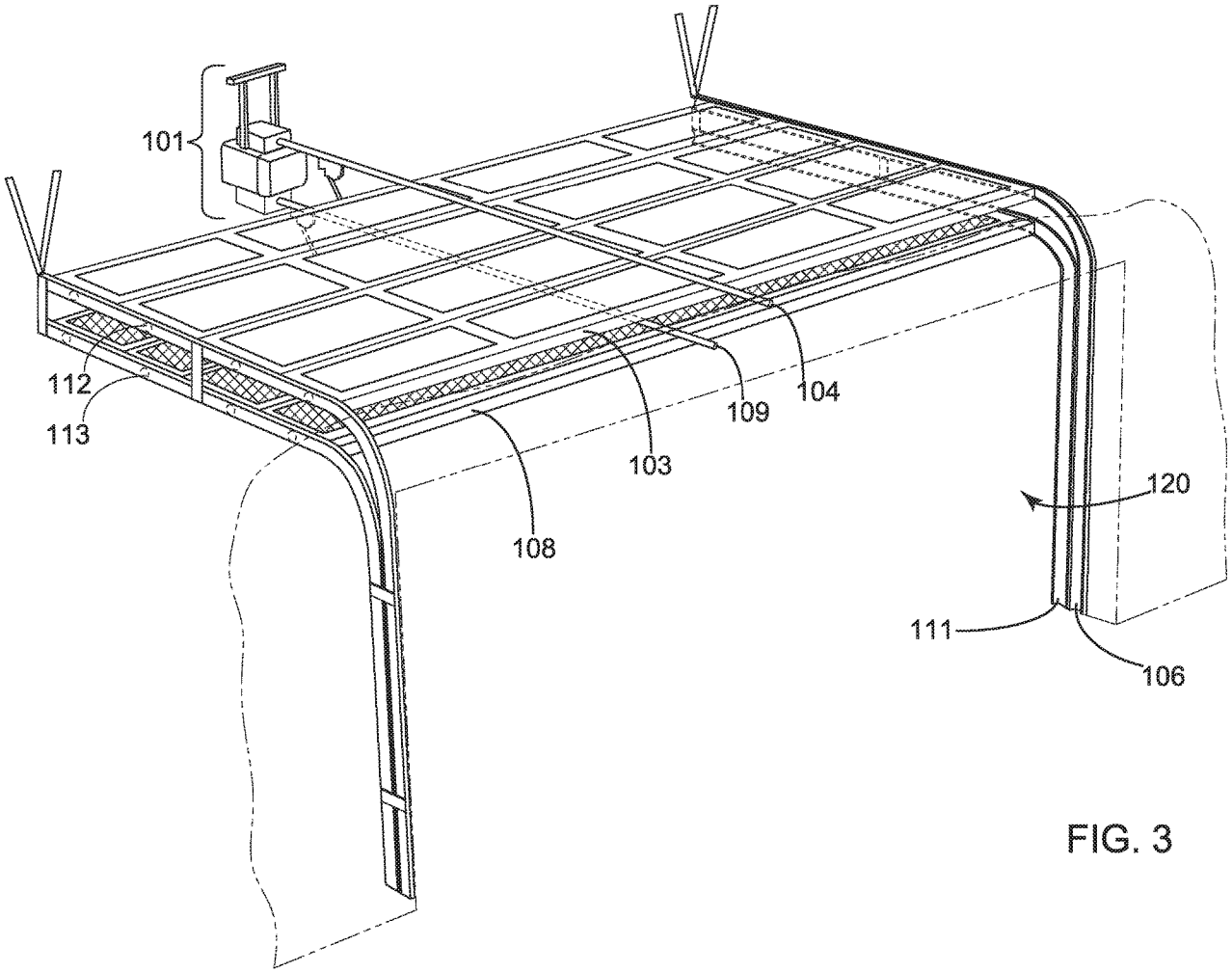
FIG. 3 illustrates a movable barrier screen assembly in accordance with an exemplary embodiment of the present invention, wherein both a garage door and a screen door are in an open travel limit position.

FIG. 1 illustrates a movable barrier screen assembly in accordance with an exemplary embodiment of the present invention, wherein both a garage door and a screen door are in a closed travel limit position. More specifically, FIG. 1 depicts movable barrier assembly 100, which comprises movable barrier operator (operator 101), including a first motor 102 adapted to control movement of a first movable barrier (barrier 103), via a chain guide or belt guide (guide 104) that guides a barrier arm 105 coupled to barrier 103. Barrier arm 105 mechanically connects motor 102 to barrier 103 so that actuating motor 102 causes barrier 103 to travel along tracks 106 between an open and closed position thereby controlling access via garage entry 120. Operator 101 further includes a second motor 107 adapted to control movement of a second movable barrier (barrier 108), via a second chain guide or belt guide (guide 109) that guides a barrier arm 110 coupled to barrier 108. Barrier arm 110 mechanically connects motor 107 to barrier 108 so that actuating motor 107 causes barrier 108 to travel along tracks 111 between an open and closed position thereby controlling access via garage entry 120 (entry 120 fully accessible when both barriers 103 and 108 are in the open travel limit position, as shown in FIG. 3).

In the exemplary embodiment of FIG. 1, operator 101 may comprise of a single housing adapted to enclose both motors 102 and 107 housed therein. These motors may be any type of motor suitable for garage door openers. In exemplary embodiments, these motors are DC motors. Each motor may be supplied power and controlled via a single circuitry or multiple control circuitries housed within operator 101.

In an exemplary embodiment, operator 101 includes a housing configured with a top protruding portion in which a part of motor 102 (or a gearbox, or components coupled to motor 102) may be mechanically connected with a chain or belt that is rotatably coupled with the motor so that when the motor turns it causes the chain or belt to turn and move arm 105 along guide 104. Similarly, the housing of operator 101 may include a bottom protruding portion in which a part of motor 107 (or a gearbox, or components coupled to motor 107) may be mechanically connected with a second chain or belt that is rotatably coupled with the motor so that when the motor turns it causes the chain or belt to turn and move arm 110 along guide 109. Because each arm 105 and 110 is coupled to barrier 103 and 108 respectively, movement of motors 102 and 107 cause the barriers to open and close as they move along tracks 106 and 111.

Tracks 106 and 111 typically run substantially parallel to one another with track 106 situated above and at an anterior portion of track 111 (with respect to barriers 103 and 108) so that track 106 is closer to an outer edge of entry 120. To facilitate travel along tracks 106 and 111, barriers 103 and 108 may typically include rollers 112 and 113 respectively. To secure each track in place and prevent misalignment or derailing of the barriers, both sets of tracks may be typically reinforced and coupled together with supports 115 situated along tracks 106 and 111. Typically, different types of supports may be implemented such as supports that hold tracks 106 and 111 together, and supports that hold tracks 106 and 111 securely against a structural component of the space—such as a garage ceiling or garage wall.

Figure 6:
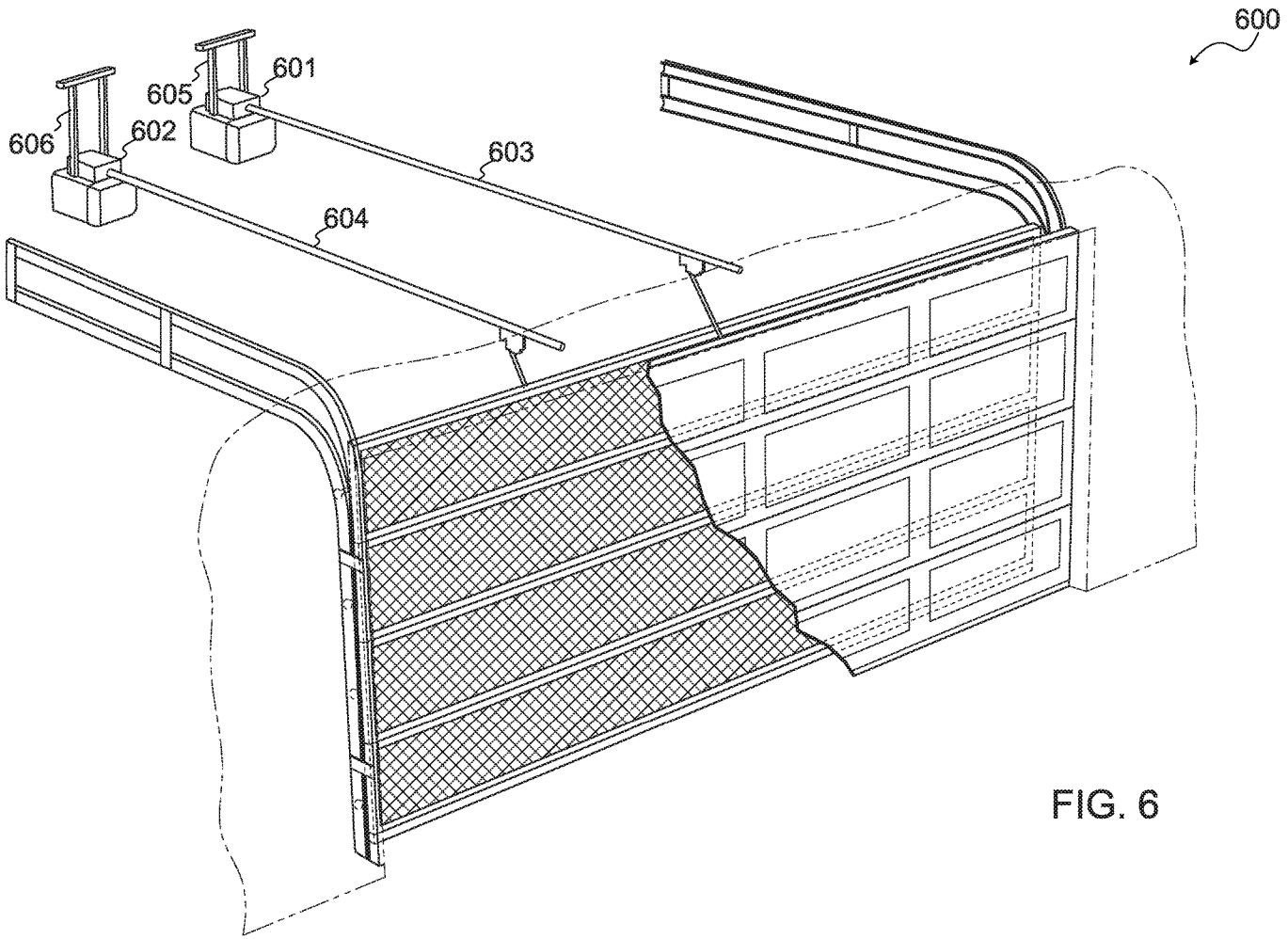
FIG. 6 illustrates a movable barrier screen assembly in accordance with an exemplary embodiment of the present invention.

Guide 104 may exemplarily run a length above barrier 103, while guide 109 may run a similar length but situated below guide 104 so that when barrier 103 is in a open travel limit position, barrier 103 will be above guide 109 and in between guides 104 and 109. In another exemplary embodiment, guide 109 may run parallel and adjacent to guide 104; such embodiment is illustrated in FIG. 6.

In yet another exemplary embodiment, guide 109 may run parallel and adjacent to guide 104 as well as leveled with each other so that guides 104 and 109 are situated at the same height. In such embodiments, one of the barrier arms 105 or 110 may be longer or extend further so as to accommodate for the different height each barrier may be situated with respect to each other. For example, and without deviating from the scope of the present invention, in an exemplary embodiment in which guide 104 and guide 109 are at the same height from the ground of the garage, barrier arm 110 may extend further to reach the lower height of barrier 108.

Figure 2:
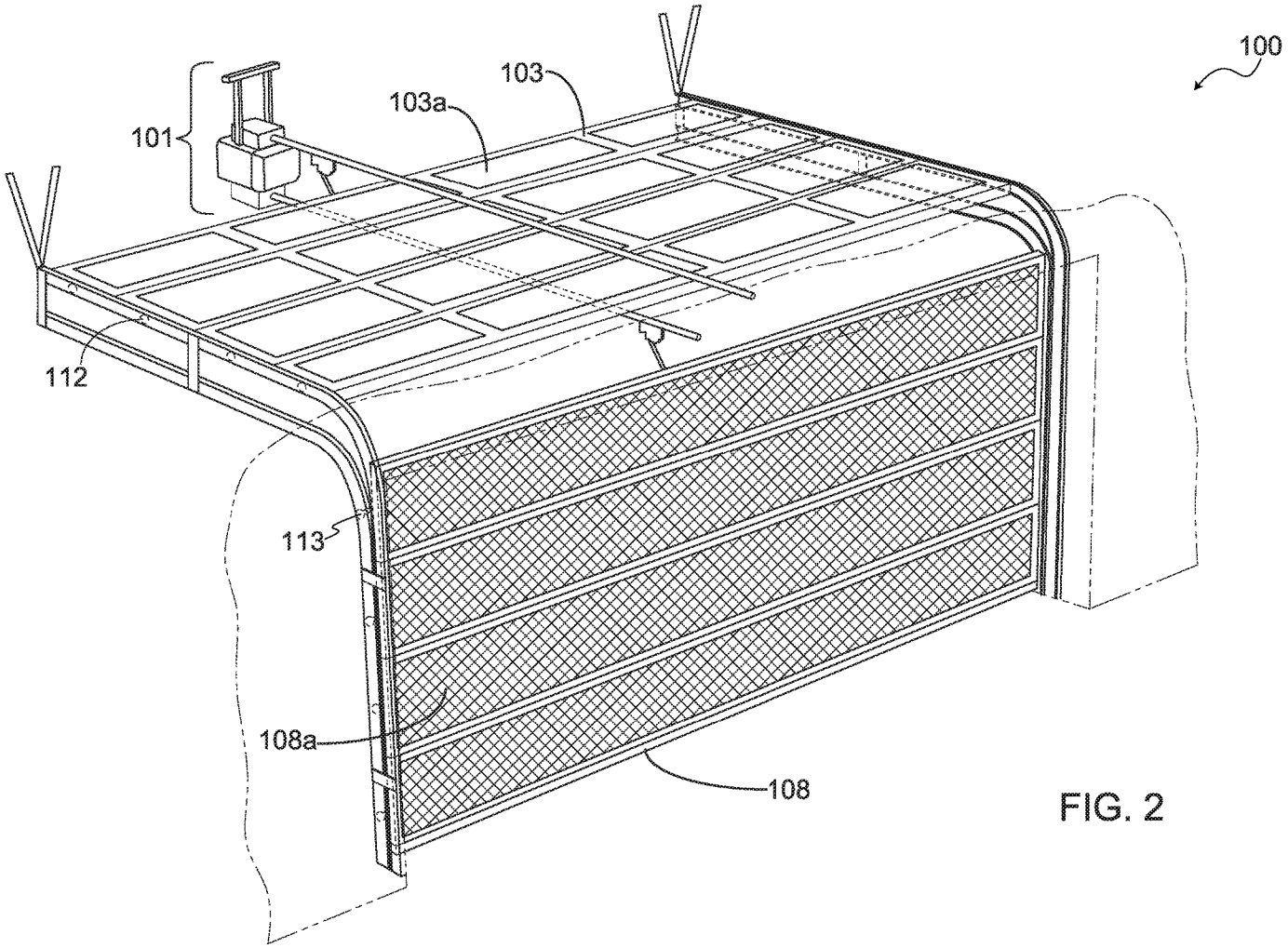
FIG. 2 illustrates a movable barrier screen assembly in accordance with an exemplary embodiment of the present invention, wherein a garage door is shown in an open travel limit position and a screen door is shown in a closed position travel limit position.

FIG. 2 illustrates a movable barrier screen assembly in accordance with an exemplary embodiment of the present invention, wherein a garage door is shown in an open travel limit position and a screen door is shown in a closed position travel limit position. More specifically, FIG. 2 illustrates movable barrier assembly 100 with the barrier 103 fully opened, and barrier 108 fully closed. In this configuration, an individual may use the garage while allowing aeration to the space and at the same time preventing debris from entering the garage. Moreover, the screen provided on each of the panels of barrier 108 will provide a measure of safety and privacy by limiting the visibility into the garage from the outside, as is common with screens implemented on windows or mosquito nets.

Barrier 103 is shown in an open travel limit position. Barrier 103 may comprise a typical construction suitable for a garage door, including panels 103*a*, rollers 112, as well as other components such as hinges, sensors (e.g. edge sensors, pressure sensors), and a drum and torsion spring system (not shown) typical of garage door assemblies.

Barrier 108 is shown in the closed travel limit position. Similarly, barrier 108 may comprise a typical construction suitable for a garage door, except that rather than implementing panels 103*a*, barrier 108 includes a plurality of panels 108*a*, each of which include a screen or mosquito net type of construction, typically although not necessarily, made of fiberglass or polyester. Although the illustrated example of barrier 108 in FIG. 2 shows four elongated panels 108*a*, a screen door or barrier 108 in accordance with the present invention may include less or more panels without deviating from the scope of the invention. As with barrier 102, barrier 108 may also include other well-known components of garage doors such as rollers 113, as well as hinges, sensors, and a drum and torsion spring system (not shown) typical of garage door assemblies.

Turning to the next figure, FIG. 3 illustrates a movable barrier screen assembly in accordance with an exemplary embodiment of the present invention, wherein both a garage door and a screen door are in an open travel limit position. From this view, it may be appreciated that in exemplary embodiments such as the one shown in the present figure, guide 109 may run substantially parallel to, and below, guide 104 in a manner so that guide 109 is situated below barrier 103 and above barrier 108 when each barrier is in an open travel limit position. While in this exemplary embodiment, guide 109 is roughly or substantially directly below guide 104, it should be noted that in alternative exemplary embodiments, guide 109 may be adjacent to or next to guide 104—depending on the configuration of the operator or operators implemented with the movable barriers—as will be discussed further below with reference to FIG. 6, which addresses an exemplary embodiment wherein guides run parallel and adjacent to each other.

Figure 4:
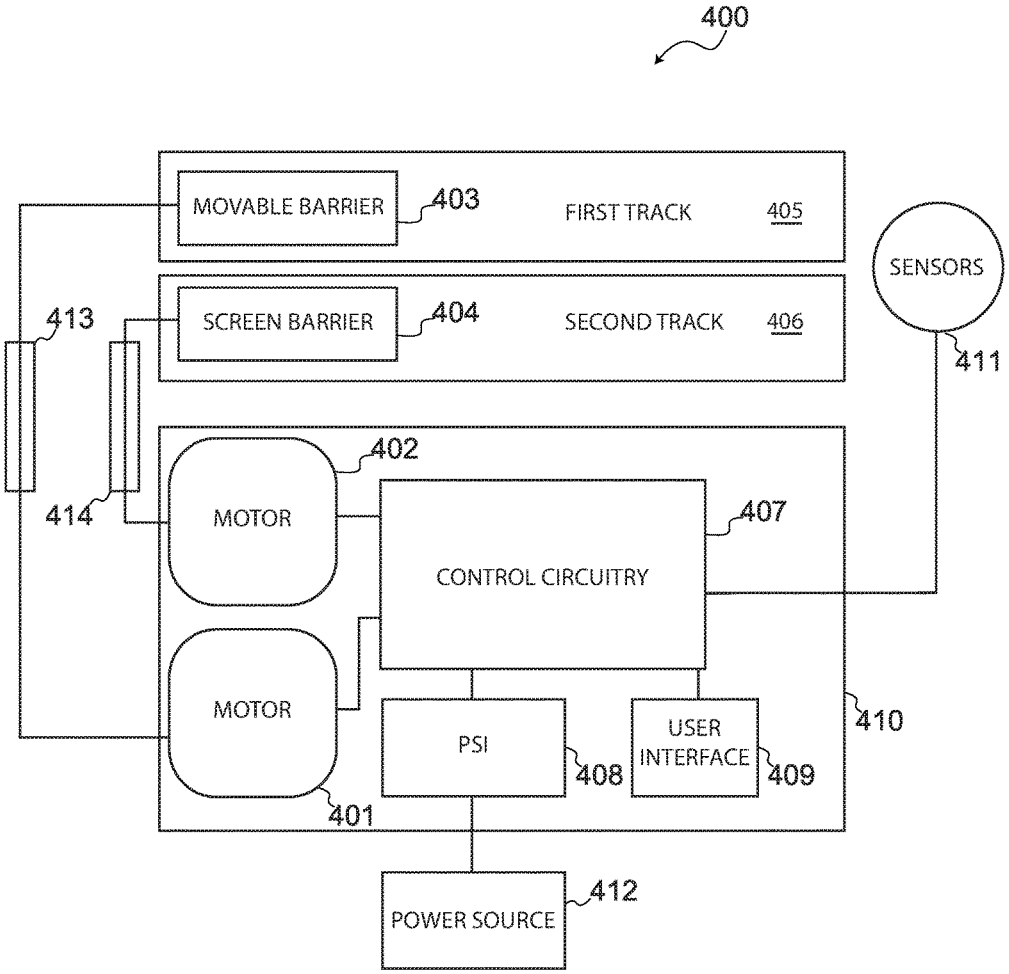
FIG. 4 illustrates a block diagram of a movable barrier system implementing a screen assembly in accordance with one exemplary embodiment of the present invention.

Turning now to FIG. 4, a block diagram of a movable barrier assembly, in accordance with one exemplary embodiment of the present invention, is illustrated. More specifically, FIG. 4 illustrates movable barrier assembly 400, comprising: operator 410, which includes motor 401 and motor 402, each motor configured to independently move barrier 403 along a first track 405 and screen barrier 404 along a second track 406, respectively; control circuitry 407 for controlling movement or actuation of each motor 401 and 402; a power supply interface (PSI 408) for supplying power to control circuitry 407 from a power source 412; and a user interface (UI 409). Typically, operator 410 will be connected to a power source 412 such as a regular power socket inside the garage space. Similarly, other typical components that may provide a desirable automated or remote activated operation of each barrier, may include sensors 411 for detecting obstructions and preventing damage to the barriers or injury to users during operation of barriers 403 and 404. Several of the components of movable barrier screen assembly 400 will be discussed in turn with reference to FIG. 4.

Operator 410 may be any type of movable barrier operator suitable to actuate, operate, or otherwise control access via barriers 403 and 404. Thus, operator 410 is typically a garage door operator that moves a garage door on a pair of tracks, except that operator 410 includes two separate motors in order to move two separate garage doors—the first garage door may be a regular garage door (i.e. barrier 403) and the second garage door may be a modified garage door or garage screen door that comprises one or more panels including a screen (i.e. screen barrier 404). In exemplary embodiments of operator 410, a single housing may enclose both motors and a single circuitry that is configured to control each motor.

Motor 401 and motor 402 may be any type of motor suitable for moving barriers 403 and 404 between an open and closed travel limit position. As such, motors 401 and 402 may be Lorentz force motors, hub motors, DC motors, AC motors, or any other type of motor known in the art and suitable for controlling barrier 403 and screen barrier 404. In exemplary embodiments, each motor may be coupled to a compact gearbox (not shown) suitable for facilitating movement of barrier 403 and screen barrier 404. In an exemplary embodiment both motors 401 and 402 are DC motors.

Barrier 403 is typically configured with rollers to travel along a barrier pathway such as track 405, which comprises a pair of tracks on opposite sides of barrier 403. In exemplary embodiments, such as the embodiments illustrated in FIG. 1 and FIG. 6, barrier 403 is a garage door.

Screen barrier 404 is typically configured similarly to barrier 403 in that it travels along a similar pathway or track 406. In exemplary embodiments, such as the embodiments illustrated in FIG. 1 and FIG. 6, screen barrier 404 is a garage screen door that comprises a screen construction of polyester, fiberglass, or any other suitable materials that can create a screen structure such that the screen allows aeration of the garage when barrier 403 is opened, but does not allow debris such as leaves to enter through the entry of the garage.

Control circuitry 407 generally includes one or more processors and memory unit, and may be configured to execute specific instructions as well as receive signals to operator 410 when an authorization to access barriers 403 and 404 can be established via remote device (not shown).

PSI 408 may be any interface suitable for connecting an operator component to a power supply. As such, a power supply interface may be a wire, a cable or conduit, or any other device including a transformer or other known components, suitable for transmitting power from a power supply to control circuitry 407. In an exemplary embodiment, PSI 408 includes a transformer for supplying DC power to motors 401 and 402 from an AC power source.

UI 409 may be as simple as one or two buttons, or as complex as a touchscreen display suitable for programming several types of instructions and or parameters stored within a memory of operator 410. Typically, a simple user interface may comprise a button for pairing one or more remote controls (not shown) with operator 410 so that barriers 403 and 404 may be operated remotely.

Sensors 411 may include photoelectric sensors, capacitance sensors, edge sensors, or any other type of travel limit sensors or obstruction sensors suitable for aiding the safe operation of each movable barrier. In an exemplary embodiment, assembly 400 utilizes a set of photo electric sensors situated at terminal ends of tracks 405 and 406.

In the embodiment illustrated by FIG. 4, guides 413 and 414 typically guide a barrier arm along a chain or belt that is rotatably coupled to one of the motors. As with known garage door operators using similar means, when the motor turns in one direction the barrier arm (not shown in FIG. 4, but see FIG. 1-FIG. 3) moves along the guide to push the barrier into a closed position or pull the barrier into an opened position. In exemplary embodiments in which operator 410 includes motor 401 and motor 402, guides 413 and 414 may be typically situated so that one guide is directly above the other guide—as shown in FIG. 1-FIG. 3. In other embodiments, however, where perhaps two separate operators are implemented to control barriers 401 and 403, then guides 413 and 414 may be positioned adjacently rather than directly above or below one another. Such exemplary embodiment, in which two separate operators are implemented to operate the garage door and garage screen door, is discussed in turn with reference to FIG. 5.

Figure 5:
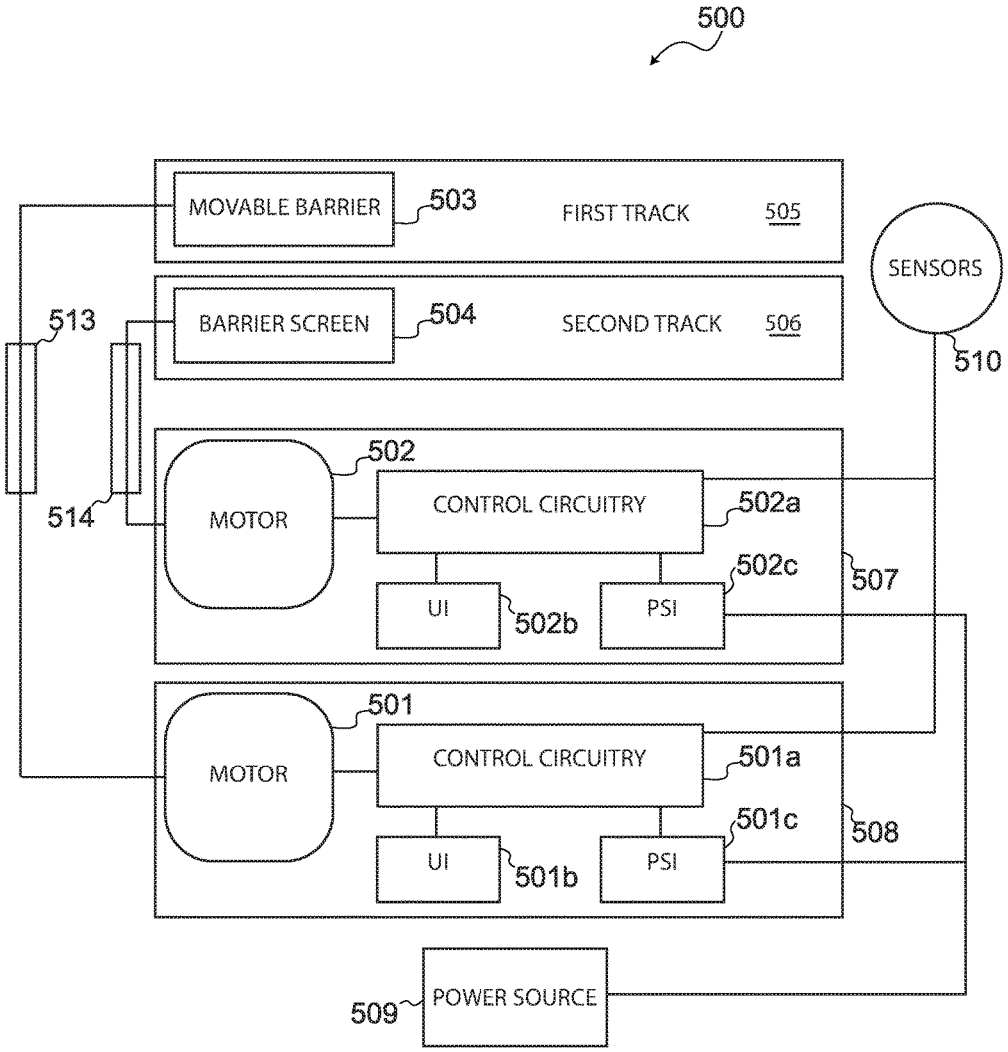
FIG. 5 illustrates a block diagram of a movable barrier system implementing a screen assembly in accordance with one exemplary embodiment of the present invention.

FIG. 5 illustrates a block diagram of a movable barrier system implementing a screen assembly in accordance with one exemplary embodiment of the present invention. As with the embodiment of FIG. 4, each barrier of the movable barrier assembly is controlled or operated by a dedicated motor. However, in the present embodiment, each motor is operated by its own operator. More specifically, movable barrier assembly 500 comprises: a first operator 508, which includes motor 501, configured to independently move barrier 503 along a first track 505; control circuitry 501*a* for controlling movement or actuation of motor 501; a power supply interface (PSI 501*c*) for supplying power to control circuitry 501*a* from a power source 509; and a user interface (UI 501*b*). Movable barrier assembly 500 further comprises: a second operator 507, which includes motor 502, configured to independently move barrier 504 along a second track 506; control circuitry 502*a* for controlling movement or actuation of motor 502; a power supply interface (PSI 502*c*) for supplying power to control circuitry 502*a* from power source 509; and a user interface (UI 502*b*). Other typical components that may provide a desirable automated or remote activated operation of each barrier may include sensors 510 for detecting obstructions and preventing damage to the barriers or injury to users during operation of barriers 503 and 504.

Rather than sharing a similar housing, each operator includes their own housing in which their respective motors are situated. Although the exemplary embodiment of FIG. 4 may be more compact, this embodiment may be desirable since it may offer users the option of installing operator 508 at adjacently (and to a side of) operator 507 in the event that clearance is limited in a particular garage space.

Because each motor and operator components are housed separately, installation of guides 513 and 514 may be different as well—although not necessarily. For example, and without limiting the scope of the present invention, operator 508 may be installed along a center portion of a garage space (where garage operators are typically installed), and operator 507 may be installed adjacent to (or to one side of) operator 508 so that motor 502 of operator 507 is positioned slightly below but not directly under motor 501 of operator 508.

Similarly, guides 513 and 514 may be installed adjacent to (or to one side of) each other so that, for example, guide 513 is positioned slightly below but not directly under guide 514. Of course, other installation configurations may be possible without deviating from the scope of the present invention. For example, the guides may be adjacent and at a similar height, or one may be above or below the other. The following figure discusses an installation alternative in accordance with the scope of the present invention, which includes two separate operators similar to the embodiment of FIG. 5.

FIG. 6 illustrates a movable barrier screen assembly in accordance with an exemplary embodiment of the present invention. More specifically, FIG. 6 depicts movable barrier assembly 600, which comprises similar components to the previous embodiments such as a garage door and a garage screen door, as well as operator 601 and operator 602. Operator 601 includes a single motor and is configured to move a garage door via a barrier arm that runs along guide 603. Similarly, operator 602 includes a single motor and is configured to move a garage screen door via a barrier arm that runs along guide 604. In this embodiment, guide 603 is situated adjacent to guide 604. Furthermore, guide 603 may be situated at a higher height than guide 604 so that when both barriers are in the open position, the garage door will be below guide 603 but above guide 604. In such exemplary embodiment, this may be accomplished simply by lowering operator 602 to a lower position than operator 601. To facilitate such installation, support members 606 may be implemented, which have a longer length than support members 605 of operator 601.

A movable barrier screen assembly in accordance with the present invention provides a screen barrier that may be left closed while a primary barrier or garage door is left open. Because each barrier is controlled by a motor and control circuitry (whether on a single operator or on multiple operators) controlling both the garage door and garage screen door may be achieved remotely and automatically. As explained above, a movable barrier screen assembly in accordance with the present invention provides several advantages. For example, and without limiting the scope of the present invention: a garage door may be left open and a garage screen may be closed to facilitate airflow into the garage space; at the same time debris, insects, or animals such as neighbors' pets may be prevented from entering the garage space. Furthermore, as with regular screen doors, a garage screen door provides some measure of privacy, and to a limited extent some measure of security.

A movable barrier screen assembly has been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching without departing from the spirit of the invention.

What is claimed is:

1. A movable barrier screen assembly, comprising:

a first movable barrier configured to travel along a first track and enclose an entry;

a second movable barrier configured to travel along a second track and enclose the entry, wherein the second movable barrier comprises a screen;

a first motor configured to move the first barrier along the first track;

a second motor configured to move the second barrier along the second track;

a first belt guide for guiding a first arm that connects the first motor to the first barrier; and a second belt guide for guiding a second arm that connects the second motor to the second barrier; and a housing for enclosing the first motor and the second motor, the first motor situated on a top section of the housing and the second motor situated on a bottom section of the housing, wherein: the first track and the second track are separated so that the first barrier and the second barrier run between respective open and closed positions on separate tracks;

the first track runs substantially parallel and above the second track, the first belt guide runs above the first movable barrier, the second belt guide runs below the first movable barrier and above the second movable barrier, and the first motor and the second motor are configured to receive power from a control circuitry adapted to control actuation of both motors.

2. The movable barrier screen assembly of claim 1, wherein the first and second motors, and the control circuitry are housed in a single enclosure.

3. The movable barrier screen assembly of claim 1, further comprising a user interface configured to communicate with the control circuitry.

4. The movable barrier screen assembly of claim 1, wherein the first and second motors draw power from the same power source.

5. A movable barrier screen assembly, comprising:

a first movable barrier configured to travel along a first track and adapted to enclose an entry;

a second movable barrier configured to travel along a second track, wherein the second movable barrier comprises a screen adapted to enclose the entry; and a movable barrier operator, including:

a first motor configured to move the first barrier along the first track;

a second motor configured to move the second barrier along the second track, wherein the first track runs parallel and directly above the second track and wherein the first track and the second track are separated so that the first barrier and the second barrier run between respective open and closed positions on separate tracks; and a control circuitry configured to provide power to drive the first and second motors, wherein the first and second motors and the control circuitry are housed together in a housing, the first motor situated on a top section of the housing and the second motor situated on a bottom section of the housing.

6. The movable barrier screen assembly of claim 5, further comprising a user interface configured to communicate with the control circuitry.

7. The movable barrier screen assembly of claim 5, wherein the first and second motors draw power from the same power source.

* * * * *